US006475096B2

(12) United States Patent
Nickolai

(10) Patent No.: US 6,475,096 B2
(45) Date of Patent: Nov. 5, 2002

(54) ROLLER BOWLER 2000

(76) Inventor: Jeanne M. Nickolai, 6246 S. Brandt Rd., Casper, WY (US) 82604

( * ) Notice: Subject to any disclaimer, the term of this patent is extended or adjusted under 35 U.S.C. 154(b) by 0 days.

(21) Appl. No.: 09/734,288

(22) Filed: Dec. 11, 2000

(65) Prior Publication Data

US 2002/0072425 A1 Jun. 13, 2002

(51) Int. Cl.[7] ..... A63D 5/00
(52) U.S. Cl. ..... 473/56; 473/107; 273/129 Q
(58) Field of Search ..... 473/54, 55, 56, 473/107; 273/129 Q

(56) References Cited

U.S. PATENT DOCUMENTS 4,046,376 A * 9/1977 Harvey et al.
4,097,045 A * 6/1978 Bechtel
4,286,784 A * 9/1981 Harvey et al.
4,368,898 A * 1/1983 Lay
5,165,690 A * 11/1992 Kelley, Jr.
5,314,384 A * 5/1994 Ross-Sullivan
5,358,446 A * 10/1994 Bergman
5,358,447 A * 10/1994 Erickson
6,042,482 A * 3/2000 Wilds

* cited by examiner

*Primary Examiner*—William M. Pierce
(74) *Attorney, Agent, or Firm*—Seto Patents

(57) ABSTRACT

An "S" shaped ramp that attaches to the lap area of a wheelchair and allows a person in the wheelchair to participate in the sport of bowling. An upper portion of the ramp releaseably attaches to the wheelchair and provides the bowler with a flat portion on which she can rest a bowling ball, before pushing the ball down the ramp for continued travel down a bowling alley. The flat upper portion of the ramp may be equipped with a "stop" or "rest" area that stops or holds the bowling ball. The stop area can be an indentation or a small "speed bump" that extends across the width of the upper portion. The ball can be placed in many different locations on the upper portion and stop area, thereby allowing the bowler to choose one from among many rolling paths for their bowling ball. The selection of rolling paths is limited by the width of the ramp, which may be two to three feet for example, and the direction in which the wheelchair faces. The lower portion slides freely on the alley floor and provides a smooth transition from the ramp to the alley. The ramp may be equipped with small curbs that run the length of both outside edges and the back edge closest to the bowler.

10 Claims, 7 Drawing Sheets

ROLLER BOWLER 2000

BACKGROUND OF THE INVENTION

The present invention relates generally to the sport of bowling and more specifically to a device that allows people in wheelchairs to bowl.

Bowling is a well known sport that is enjoyed by people of all ages and experiences. Bowling is an indoor game in which players roll balls along a runway called an alley, in an attempt to knock over ten uprights, called pins, in the fewest possible rolls. The balls, alley, and pins may be made of wood or synthetic materials. The game, sometimes called tenpins, is popular mainly in the United States and Canada. A variant known as skittles is played in Germany, where it is thought the game originated.

In 1895 the American Bowling Congress (ABC) was formed and established rules and specifications, which, with few modifications, have been observed ever since. The ABC supervises the activities of thousands of bowling groups and holds an annual championship tournament in which titles are awarded to teams and individuals. In addition, the Women's International Bowling Congress, organized in 1916, holds similar annual tournaments for women. The Young American Bowling Alliance governs the sport for youths.

The game is played on a level alley 41" to 42" (inches) wide, measuring 60 ft. from the center of the first, or head, pin to the foul line behind which the bowler must release the ball. The approach to the foul line consists of a runway of at least 15 ft. on which the player may take several steps before releasing the ball. Less than 2" back of the last row of pins is a padded pit that receives the balls and overturned pins. The pins are placed on pin spots about 2.3" in diameter (the size of the bottom of the pin) and 12" apart from center to center. The pins form a triangle consisting of four rows, the first of which consists of a single pin. The pins are 15" in height, with a minimum weight of 3 lbs. The neck of a pin is narrow and the sides taper slightly to the base. The bowling ball must not exceed 27" in circumference and 16 lbs. in weight, but smaller sizes and weights are permissible. The ball usually contains three finger holes.

The game may be played by any number of contestants. Each player rolls in turn (called a frame), attempting to knock down all the pins with two balls rolled one at a time. If the player knocks down all ten pins with the first ball, the player is credited with a "strike," and adds the ten points thus scored to the number of points made on the next two balls the player rolls. If the player knocks down some of the pins with one ball and the remaining pins with the second ball, a "spare" is scored, and to the ten points thus scored the player adds the points gained on the first ball rolled by that player during the next frame. Ten frames for each player constitute a game; and the highest score possible is 300.

Enthusiasm for bowling has steadily increased since about 1952 with the introduction of automatic pinspotters that quickly reset the pins after each frame, and later, with the introduction of automatic scoring devices. Today, bowling ranks among the most popular participant sports in the world. More than 100 million people in 80 countries participate in bowling.

A prior invention that extended the joy of bowling to a person in a wheelchair was a free standing metal stand that provided two rails on which the bowler would roll the ball. This metal stand did not attach to the wheelchair and limited the bowler's control of the roll. The bowler neither controlled the placement nor the facing direction of the stand simply by positioning her wheelchair.

SUMMARY OF THE INVENTION

The present Roller Bowler 2000 allows a person in a wheelchair to enjoy the sport of bowling. The Roller Bowler 2000 comprises a ramp that can be removeably attached to a wheelchair. The ramp provides a flat upper portion on which the bowler can rest a bowling ball before pushing it along a selected path down the ramp. The ramp is general flat and has two main curves giving it a "S" shape. The bowling ball is pushed over the first curve and picks up speed as it travels generally downward toward the floor. The ball then travels over the second curve which provides a gentle transition from the ramp to the bowling alley. When the ramp is attached to the wheelchair, the bowler is free to position herself anywhere on the bowling alley floor she chooses. In the preferred embodiment, the ramp is two feet wide and the bowler may initiate her roll from multiple positions on the upper portion of the ramp.

The present bowling ramp can be attached to the wheelchair by adjustable clamps that clamp on to both side panel armrests of the wheelchair. Bumpers, or raised edges, are included along both longitudinal sides of the ramp to prevent the bowling ball from falling off a side edge while traveling down the ramp. A back edge bumper made of a soft material like foam rubber keeps the ball from rolling backwards onto the bowler and also provides a soft armrest for the bowler. The bowling ramp can maintain a constant width or may alternatively become more narrow or wider as it extends from the upper portion.

BRIEF DESCRIPTION OF THE DRAWINGS

The invention of the present application will now be described in more detail with reference to the accompanying drawings, given only by way of example, in which.

DETAILED DESCRIPTION OF THE INVENTION

Figure 1:
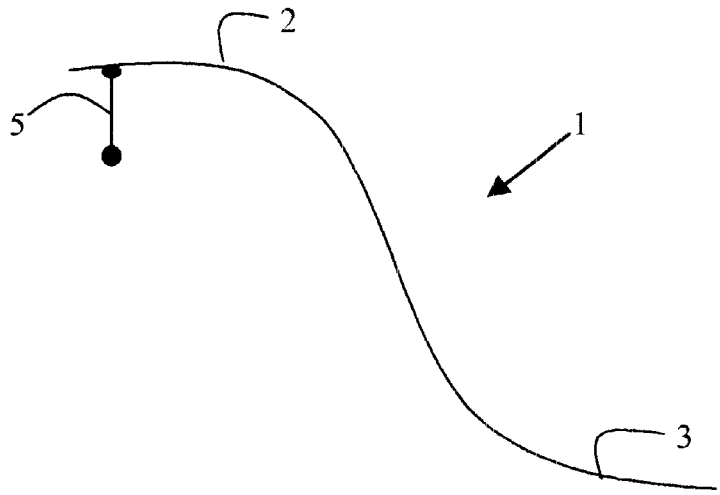
FIG. 1 shows the profile of the preferred embodiment.

Referring to FIG. 1, the present wheelchair bowling ramp 1 has a general "S" shape with an upper portion 2, at the top of ramp 1, and a lower portion 3 at the bottom end of ramp 1. On the under side of upper portion 2 is attachment device 5. Preferably, attachment device 5 is an adjustable arm with a rounded clamp at it's terminal end that clamps on to side panel armrests of a wheelchair, thereby securing ramp 1 in place for bowling. Upper portion 2 provides a flat and stable surface on which the bowler can rest a bowling bowl prior to pushing it down ramp 1. In the preferred embodiment, upper portion 2 is 24" (inches) wide and 12" long thereby providing a large surface on which the bowler may selectively place the ball. Ramp 1 may remain the same width for its entire length or in alternative embodiments the width of ramp 1 may narrow or widen as it extends toward the bowling alley floor. Lower portion 3 provides a gentle sloop between ramp 1 and the bowling alley floor so that a ball makes a smooth transition from the ramp 1 to the floor.

Lower portion 3 is not attached to the floor and in fact is intended to slide freely over the bowling alley floor. This allows the wheelchair bowler to be the master of the roll. It is easily understood that the direction in which the bowling ball travels, or at least is initially pushed, will greatly impact the likelihood of any bowling pins being knocked down. The present Roller Bowler 2000 allows this initial direction to be totally under the control of the bowler, she sets up her wheelchair in the direction of her choosing. Thus many more degrees of freedom are given to the bowler with the present invention than with prior wheelchair bowling ramps that consisted of two metal rails that only gave the bowler one path on which to launch the bowling ball. Now, wheelchair bowlers can set their own angle of delivery down the alley and also choose multiple paths, within a 24" wide limit, for the ball to travel down that chosen angle. Lower portion 3 can optionally be coated with a low coefficient of friction substance, such as polyurethane for example, in order to promote free sliding of ramp 1 over the floor of the alley.

Figure 2:
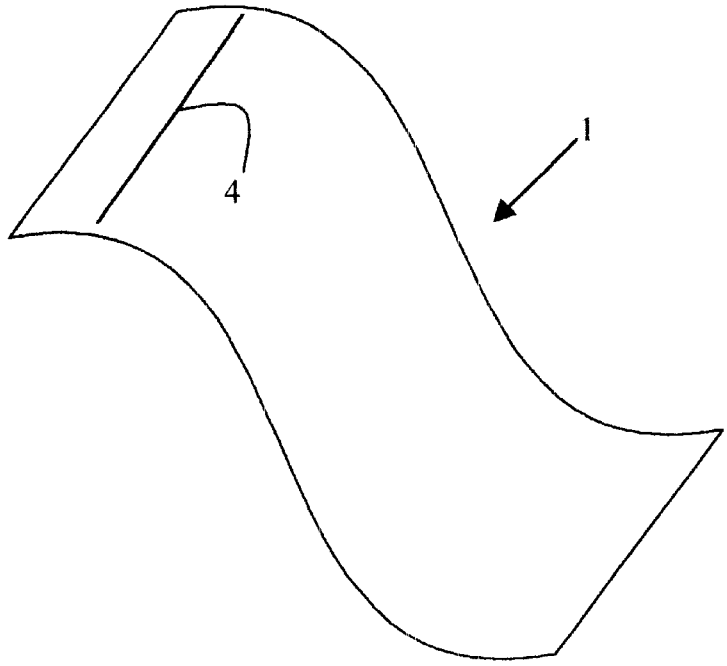
FIG. 2 shows a frontal view of the preferred embodiment.

FIG. 2 shows the "stop" or "rest" feature of bowling ramp 1. Upper portion 2 is optionally provided with an indent 4 or small "speed bump" that runs across the width of the upper portion 2. The preferred "rest" feature is an indentation 4 that allows a bowling ball to be securely captured therein, thereby letting the bowler concentrate on the proper angle and path of the ball, without having to worry about the ball rolling down the ramp 1 prematurely. Other safety features, such as side and rear "bumpers", are of course included in the present invention. Preferably, the side bumpers are made of the same material as the ramp 1 and are integrated into the manufacturing process. The rear bumper is preferably foam rubber and not only prevents the bowling ball from rolling backwards into the bowler, but also provides a soft armrest for the bowler. The side and rear bumpers can be thought of as forming an upside down "U" on top of ramp 1. Thus, the only possible exit for a ball is the end of the ramp, furthest from the bowler, that leads to the alley.

Figure 3:
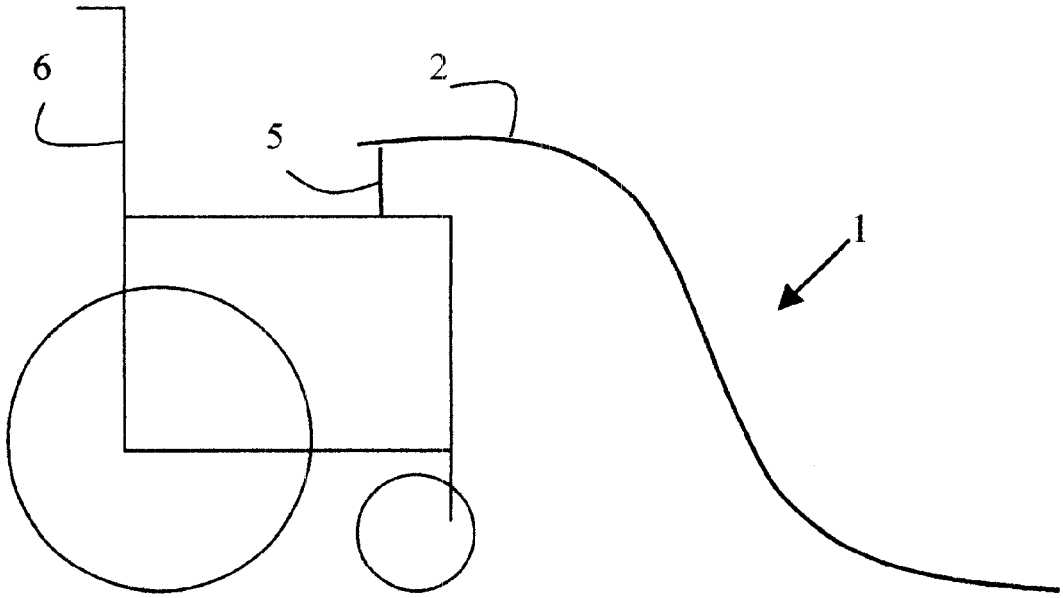
FIG. 3 shows the preferred embodiment operationally attached to a wheelchair.

FIG. 3 shows the ramp 1 operationally attached, via attachment device 5 to wheelchair 6. In the preferred embodiment, attachment device 5 clamps on to the side panel armrests of wheelchair 6 with clamps that have been coated with a non-scratching material, such as rubber for example. The clamps of device 5 are preferably coated in order to prevent scratching of the side panel armrests which are usually made of chrome. The coated clamps of attachment device 5 may optionally be slightly curved so as to align with the curved portion of the wheelchair armrests. It should be understood that there are at least two attachment devices on the under side of upper portion 2. One attachment device attaching to each of the two armrests, so that level and secure support is provided for ramp 1. The clamps of attachment device 5 are connected to upper portion 2 via adjustable tubes made of a sturdy material such as metal for example. The tubes may be adjusted via a well known pressure button system wherein, when a button that extends through an outer tube is pushed in, the outer tube is allowed to slide inward or outward, thereby shortening or extending the attachment device, respectively. When the pressure button is allowed to return to its extended position, through a hole in the outer tube, the length of the attachment device tube is locked in place.

Figure 4:
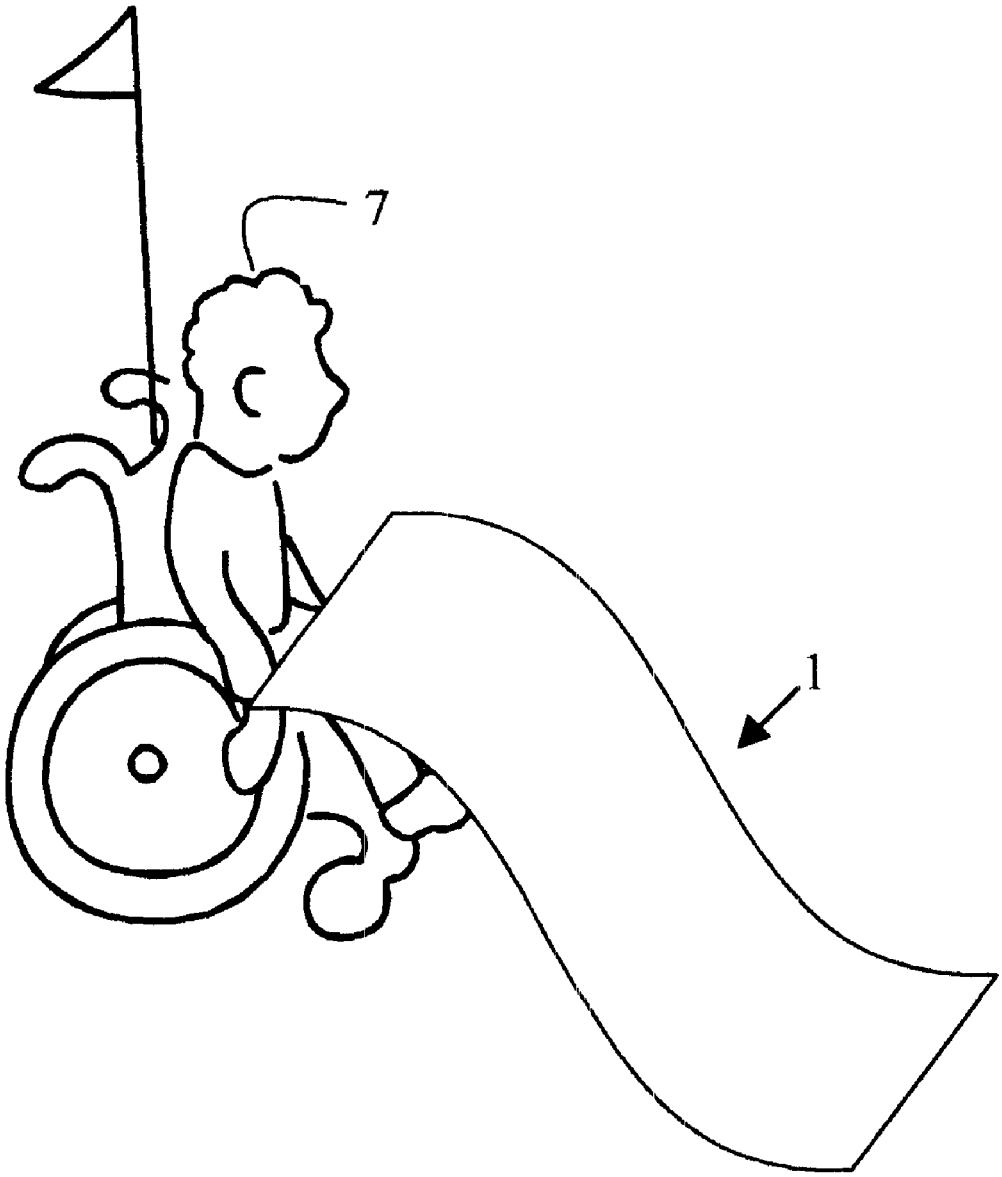
FIG. 4 shows the preferred embodiment in operation.

FIG. 4 shows a happy bowler 7 who has bowling ramp 1 attached to his wheelchair. Happy bowler 7 is adjusting the position of his wheelchair so that it is pointing in a desired direction. As mentioned above, the lower portion of ramp 1 slides freely over the bowling alley floor. Therefore, bowler 7 is free to set himself up at the very beginning of the alley or ten feet back from the beginning of the alley, whichever he chooses. Further, once the starting position is chosen, bowler 7 is free to make slight adjustments to the direction is which he and his wheelchair are facing. This is usually done be making slight adjustments, forward or backwards, to one of the wheels of the wheelchair. Once bowler 7 selects his position on the floor and direction or angle of facing down the alley he may lock the wheels, or lock the brakes, that come with the wheelchair. At this point the bowler is ready to initiate their roll and enjoy a competitive game of bowling.

Figure 5:
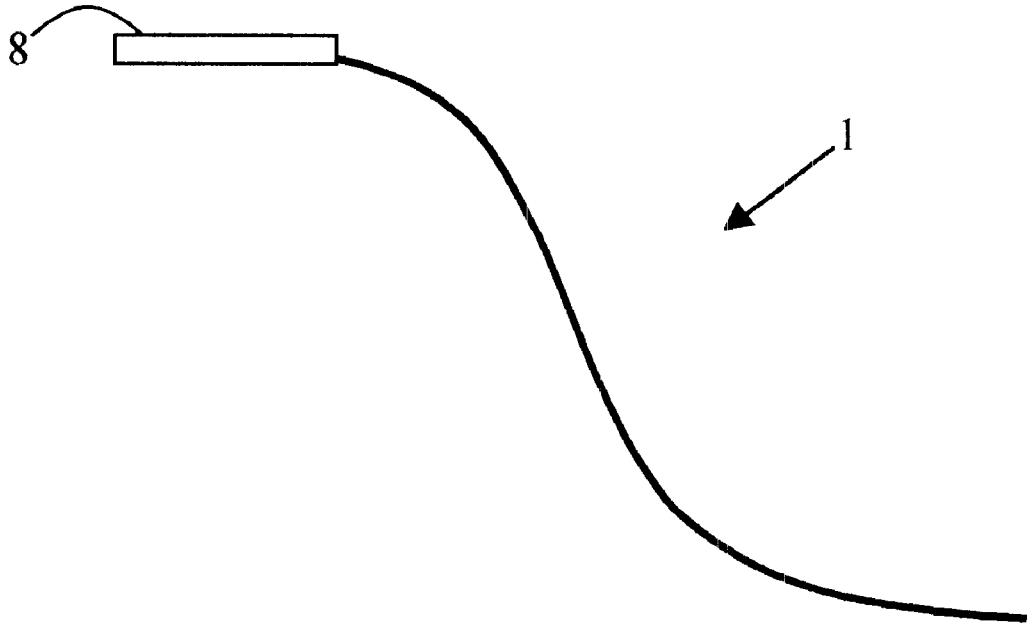
FIG. 5 shows a profile of an alternative embodiment.

FIG. 5 is a profile view of the roller bowler ramp 1 and optional bumpers 8.

Figure 6:
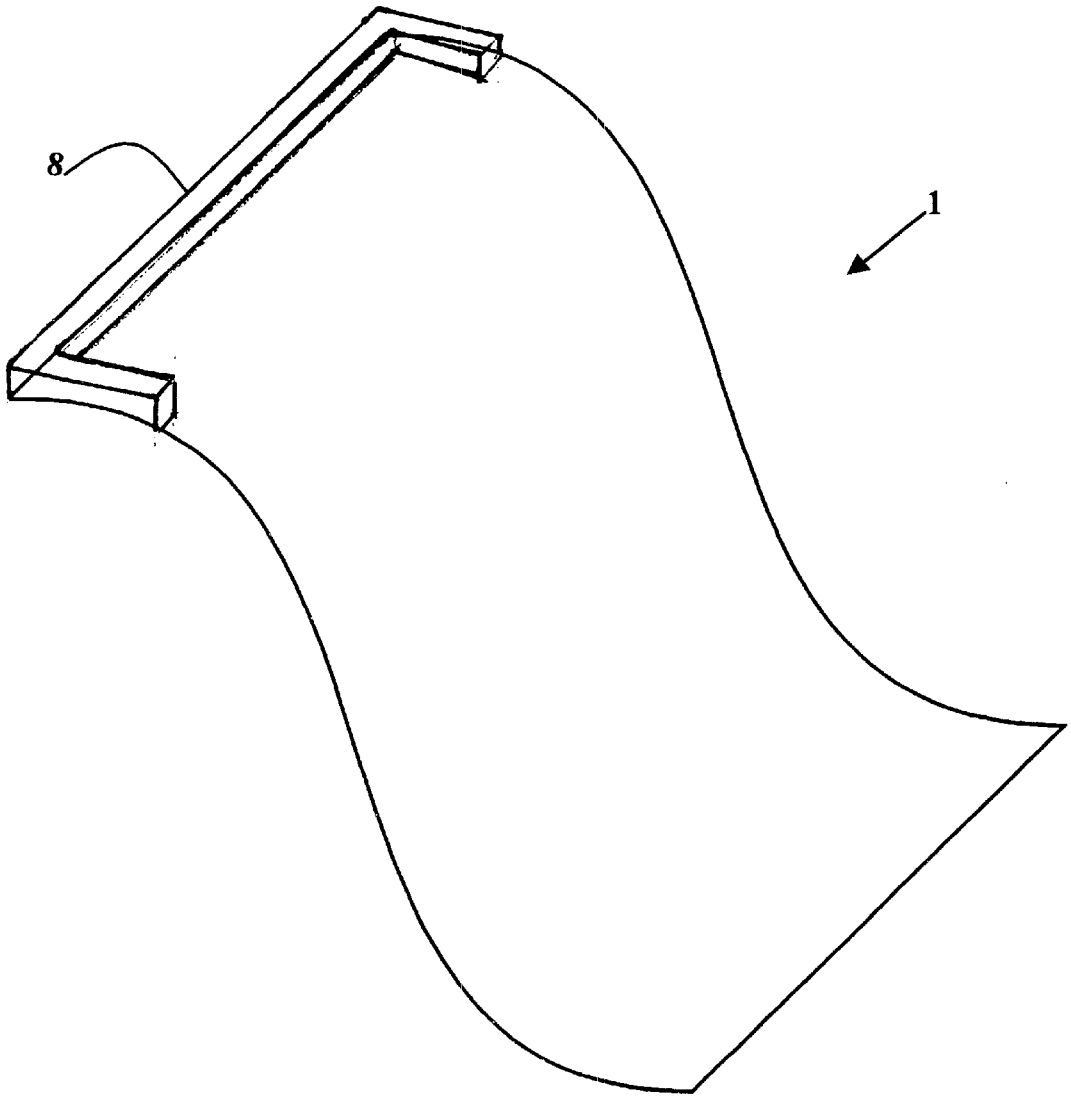
FIG. 6 shows the bumpers of the alternative embodiment.

FIG. 6 shows the "U" shaped bumper 8, which extends along the back edge of the upper portion of the ramp 1. Bumper 8 also extends out from the back edge along the right and left sides of ramp 1. The length of the right and left bumper extensions are approximately six inches in an exemplary embodiment. Bumper 8 is preferably made of a soft yet firm material such as foam rubber and has a height of approximately two inches. Bumper 8 prevents a bowling ball from rolling backwards onto the bowler and from rolling off of the upper edges of ramp 1.

Figure 7:
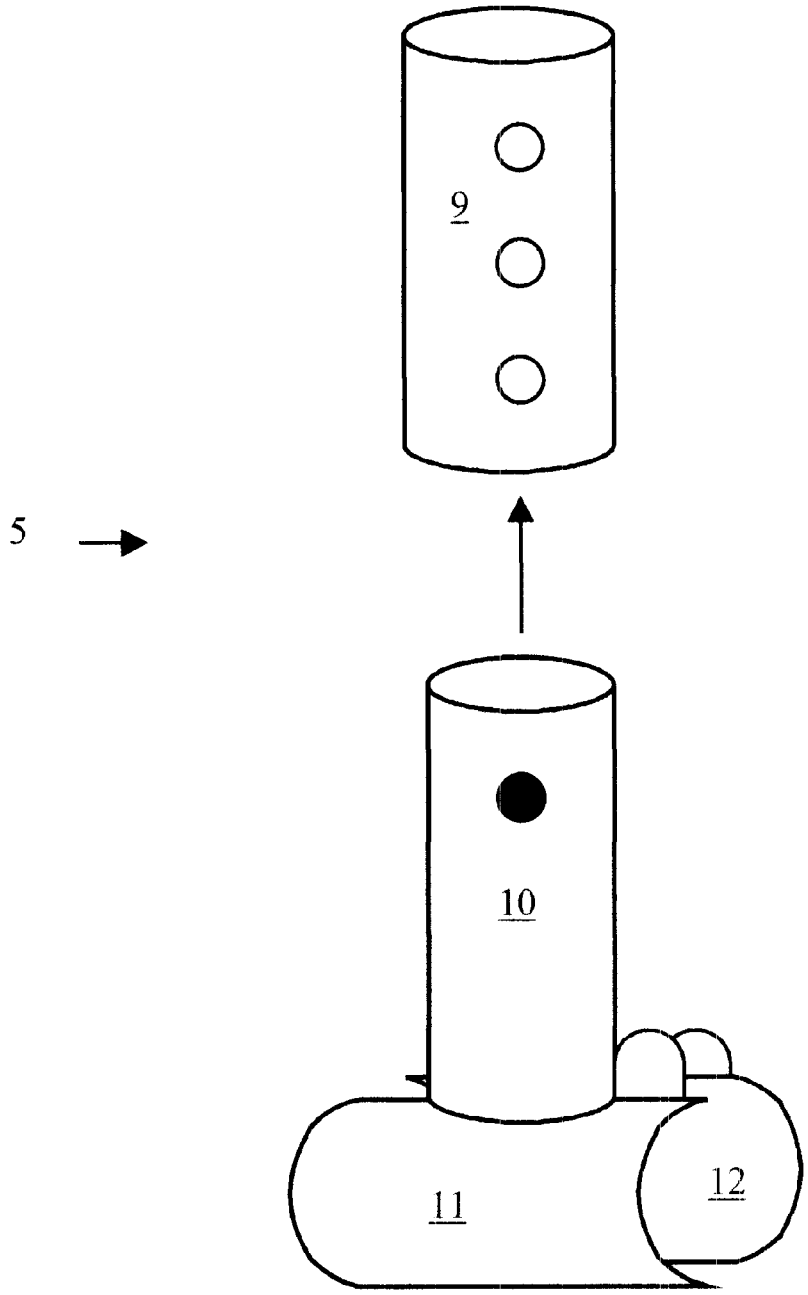
FIG. 7 shows a clamp that attaches the invention to a wheelchair.

FIG. 7 shows the preferred attachment device 5 for attaching the present ramp to the armrests of a wheelchair. In the preferred embodiment, upper section 9 is permanently attached to the upper portion ramp 1, Upper section 9 has a circumference that is slightly larger than lower section 10, and is designed to allow lower section 10 to slide into the interior of the upper section 9. A spring loaded button in the lower section 10, which can be pushed in with a person's finger or thumb, is designed to engage any of the multiple holes of upper section 9. This well-known spring loaded button and multiple hole engagement system allows for adjusting the height of the ramp in relation to the wheelchair. Lower section 10 is permanently attached to clamp section 11. The preferred device for attachment to the wheelchair is a spring loaded butterfly clamp that is biased in the closed position. Both clamp sections 11 and 12 have thumb presses that are squeezed together to open the clamp. While in the open position the clamp sections 11 and 12 are placed around the armrest of a wheelchair. The tumb presses are then released thereby securing the roller bowler to the wheelchair.

Figure 8:
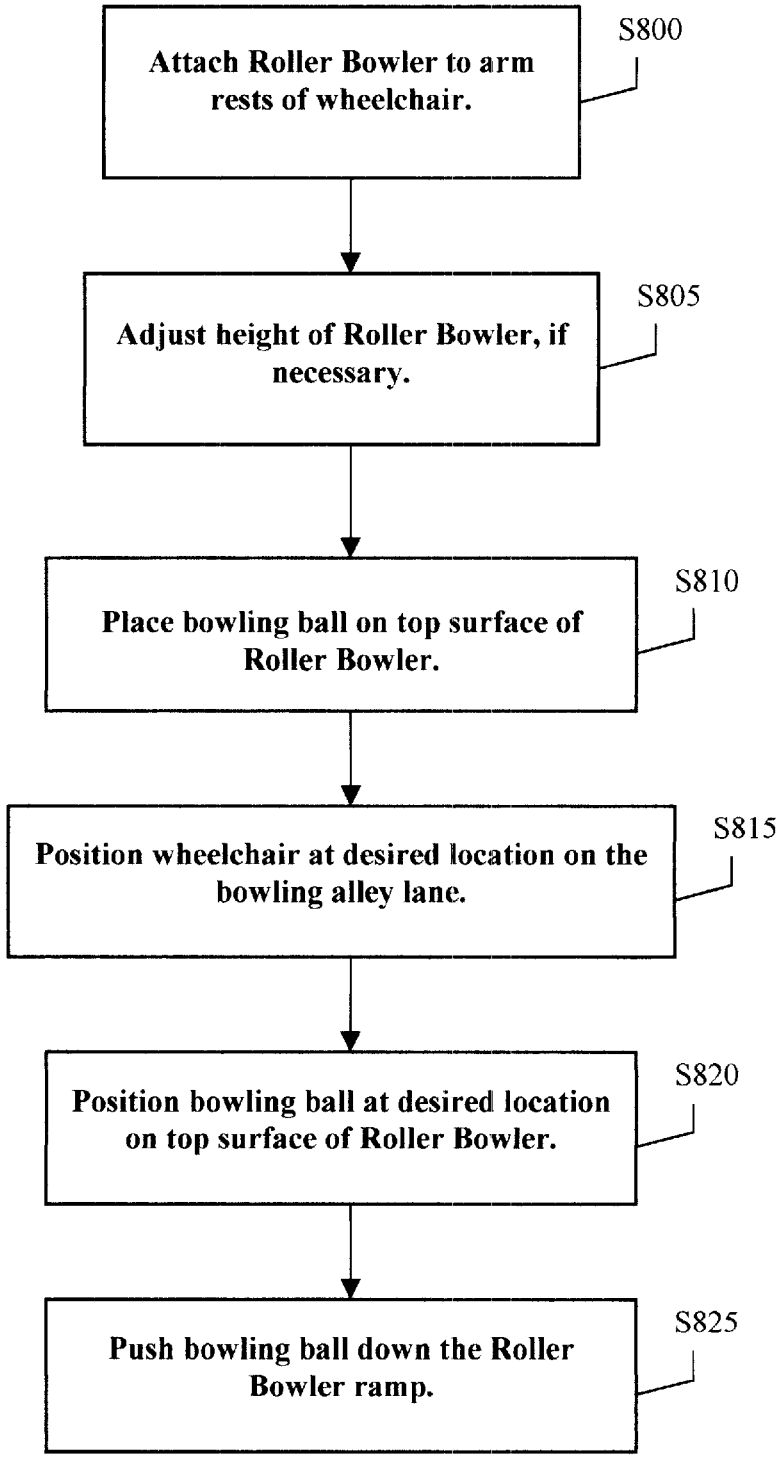
FIG. 8 is a flow chart for the present method.

FIG. 8 is a flow chart showing the steps for using the present invention. In step S800, the roller bowler is attached to the armrests of the wheelchair. Traditional wheelchairs have short cushioned armrests that lay on top of a tubular metal frame that extends past the cushion before angling downward. Preferably, the butterfly clamps of the roller bowler are clamped onto the tubular metal portion of the armrest. In step S805, the spring loaded button of the attachment device is pushed in and adjusted to engage a higher or lower hole in order to adjust the height of the upper portion of the ramp. A bowling ball is placed on the upper surface of the ramp in step S810. While the roller bowler is attached to the wheelchair, the bowler is free to move her wheelchair and position it at any desired location and direction on the bowling alley floor, step S815. Of course this step, S815, can precede step S810 by having a second person place the ball on the ramp after the bowler has positioned her wheelchair. Once the bowler has found her preferred position for the wheelchair, at step S820, the bowler positions the bowling ball at the desired location on the upper surface of the roller bowler. The flat design of the present ramp allows the bowler to release the bowling ball from multiple positions across the roughly two feet wide ramp. Thus without moving her wheelchair, the bowler can release two different bowling balls that travel paths that are almost two feet apart. Once the position of the wheelchair on the floor and the position of the bowling ball on the ramp are set, the bowler pushes the ball down the ramp, step S825, and hopes for a strike.

The foregoing description of the specific embodiments will so fully reveal the general nature of the invention that others can, by applying current knowledge, readily modify and/or adapt for various applications such specific embodiments without departing from the generic concept. Therefore, such adaptations and modifications should and are intended to be comprehended within the meaning and range of equivalents of the disclosed embodiments. It is to be understood that the phraseology of terminology employed herein is for the purpose of description and not of limitation.

I claim:

1. A bowling ramp adapted to be attached to a wheelchair that allows a person in a wheelchair to bowl, the ramp comprising;

a "S" shaped board that has an upper portion, a descending portion and a lower portion, wherein:

the upper portion releasably attaches to armrests of the wheelchair and provides a flat surface on which the person may place a bowling ball on multiple positions along a width of the upper portion;

the descending portion connects the upper portion to the lower portion; and the lower portion slides over a floor of a bowling alley and provides a smooth transition from the ramp to the floor of the bowling alley; and further wherein the person in the wheelchair maintains controllable movement of their wheelchair after the ramp is attached and is able to position the wheelchair arid ramp at any location of their choosing on the bowling alley floor and the person also controls and chooses the facing direction of the wheelchair and the attached bowling ramp.

2. The bowling ramp of claim 1 wherein, the upper portion has a rest portion that extends across the width of the upper portion that allows the person to rest the bowling ball on any location along the width of the upper portion without a chance of the ball rolling down the board prematurely.

3. The bowling ramp of claim 1 wherein, the upper portion of the bowling ramp comprises adjustable attachment devices for releasably attaching the ramp to the wheelchair.

4. The bowling ramp of claim 1 wherein, the bowling ramp has side and rear bumpers that prevent the ball from rolling off of the side or rear of the ramp.

5. The bowling ramp of claim 3 wherein, the adjustable attachment devices each comprise:

pressure button adjustable slide locking tubes that provide increasing and decreasing lengths of the attachment device; and pressure clamps that clamp to a portion of the wheelchair.

6. A method of bowling for a person in a wheelchair that allows the person to maintain complete control of the wheelchair after a bowling ramp—that is adapted to be attached to the wheelchair—has been attached comprising the steps of:

attaching an upper portion of the bowling ramp to the wheelchair wherein, the ramp is a board with a general "S" shape and further has an upper portion that provides a flat surface with multiple positions on which the person can place a bowling ball prior to initiating a roll;

locating the wheelchair and ramp in a location of the person's choosing on the bowling alley floor;

facing the wheelchair and ramp in a direction of the person's choosing;

placing the bowling ball on the upper portion of the ramp; and initiating the roll by pushing the ball down the ramp.

7. The method of claim 6, further comprising the step of:

providing bumpers along both longitudinal sides and along the rear of the ramp, so that the bowling ball can not roll off a side or the rear of the ramp.

8. The method of claim 6 wherein, the step of attaching further comprises:

using adjustable arms to clamp the ramp to the wheelchair wherein one end of each adjustable arms is a clamp that releasably clamps onto a portion of the wheelchair.

9. The method of claim 6 wherein, the step of placing further comprises:

including a rest area in the upper portion of the ramp, wherein the rest area is an indentation in the ramp that extends across the width of the upper portion that can hold the bowling ball without a chance of the ball rolling down the ramp prematurely.

10. The method of claim 6 wherein, the upper portion of the bowling ramp is 1½ to 3 feet wide.

* * * * *